United States Patent [19]

Reitz

[11] 4,013,048

[45] Mar. 22, 1977

[54] BOURKE TYPE ENGINE

[76] Inventor: Daniel M. Reitz, 19024 Leadwell St., Los Angeles, Calif. 91335

[22] Filed: Dec. 12, 1975

[21] Appl. No.: 640,183

[52] U.S. Cl. ..... 123/56 BC; 123/197 A; 92/187; 403/152; 403/116

[51] Int. Cl.[2] ..... F02B 75/28

[58] Field of Search ..... 123/56 BC, 56 AC, 56 R, 123/197 R, 197 A, 197 AB; 92/187; 403/150, 151, 152, 116

[56] References Cited

UNITED STATES PATENTS

| | | | |
|---|---|---|---|
| 545,502 | 9/1895 | Hennegin | 123/56 BC |
| 785,713 | 3/1905 | Clark | 123/56 BC |
| 1,045,505 | 11/1912 | Brauer | 123/56 BC |
| 1,073,656 | 9/1913 | Barker | 123/56 BC X |
| 1,201,401 | 10/1916 | Weatherway | 123/56 BC |
| 1,774,105 | 8/1930 | Neldnee | 123/56 BC |
| 1,825,278 | 9/1931 | Marvin | 123/56 BC |
| 2,990,226 | 6/1961 | Fangman | 92/187 |
| 3,004,810 | 10/1961 | King | 92/187 X |
| 3,357,318 | 12/1967 | Packard et al. | 92/187 |
| 3,517,652 | 6/1970 | Albertson | 123/56 BC |

*Primary Examiner*—C. J. Husar
*Assistant Examiner*—Ira S. Lazarus
*Attorney, Agent, or Firm*—William H. Pavitt, Jr.

[57] ABSTRACT

In a Bourke type engine wherein at least two cylinders are disposed coaxially and oppositely so that the free ends of piston rods extending from pistons reciprocable in said cylinders may be connected by a yoke in coaxial alignment with each other and with the cylinders to reciprocate concurrently as a unit, with the yoke having means rotatably to engage a rotating crank by which the force developed by reciprocation of the pistons is converted to rotating driving motion, the improvements wherein the inner end of the piston rod is placed in abutment with the underside of the piston head and the yoke is modified to house a block slider instead of a rolling bearing to provide better bearing surfaces and lubrication thereof.

7 Claims, 7 Drawing Figures

BOURKE TYPE ENGINE

BACKGROUND OF THE INVENTION

1. Field Of The Invention

This invention relates to internal combustion engines of the special type known as the Bourke engine, certain features of which were the subjects of U.S. Pat. Nos. 2,122,676, 2,122,677 and 2,172,670 and the history and details of which engine are more fully described in a publication entitled *Bourke Engine Documentary* by Lois Bourke, copyrighted by the author in 1968, and printed by D. D. Enterprises of North Hollywood, Calif. 91601.

2. Description Of The Prior Art

The principal prior art relating to the present invention comprises the three United States patents and publication heretofore identified, together with a patent application Ser. No. 726,321, filed May 18, 1934, by Russell L. Bourke, which is referred to in U.S. Pat. No. 2,122,676, but on which application no patent ever appeared to have issued; and various engines made and operated as described in said publication.

It is well known by persons familiar with the Bourke engine that it is comprised of pairs of cylinders with each pair coaxially aligned and disposed back to back with the piston rods extending from the pistons reciprocating in each of these cylinders also coaxially aligned and being joined by a yoke. The center of the yoke is transversely slotted to receive the throw of a crank so that, as each pair of pistons and their yoke-joined piston rods reciprocate as a unit, the crank throw will not only be reciprocated with and in the direction of the yoke, but it will also reciprocate transversely in the yoke slot. Thereby there is imparted to the crank shaft the desired rotary driving motion from the reciprocation of the paired pistons which are interconnected through their rods and the yoke to move reciprocally as a unit.

While the theory and principle of operation of the Bourke engine are such that this engine offers many advantages over more conventional internal combustion engines, certain mechanical problems have been observed in Bourke type engines which have heretofore been built and tested, and these problems appear to have contributed to the apathy of engine builders toward the Bourke engine. Among these problems have been:

1. The piston rods have been secured internally from the piston head in such a manner that the full thrust load of the piston has been carried by each of (a) a pin passed diametrically through the piston walls; (b) a yoke on such pin; and (c) a wrist pin passed transversely through the end of the piston rod and said piston yoke. Over long sustained operation of the engine, it is felt that such load carrying pins and yoke may be subject to such possible metal fatigue as to cause a fracture of any one of them with resulting serious damage to the engine. In addition, the pin extending through the piston walls has not been anchored against axial displacement so that such displacement can occur, and when it does, one end of the pin may gouge the wall of the cylinder in which the piston is reciprocating.

2. It has also been found that in Bourke engines heretofore built and tested there has been created an undesired side loading effect as the piston reciprocates in its cylinder. This is because, at least in part, of the articulated manner in which the piston thrust load has been conducted to the piston rod through the pins and yoke described in the preceding paragraph.

3. In the yoke and crank throw assemblies of Bourke engines heretofore constructed and operated, the theory of construction and assembly has been to provide a roller load bearing which rolls first in one direction; then, after rolling a certain distance, reverses its direction of roll and then rolls for such predetermined distance in the opposite direction transversely of the axis of movement of the piston, piston rod and yoke assembly. It has been found in practice, however, that, as the engine speed increases, insufficient time is provided to enable the roller bearing to reverse its direction of roll within the yoke slotting. As a result, the driving load is imposed on limited arcuate surfaces to cause wear to the same and to develop high frictional losses.

The foregoing problems appear to be among those which appear as yet to have prevented widespread acceptance of the Bourke engine construction among engine builders and automotive companies, despite the many advantages which the Bourke engine construction and its operation offers over present popular engine designs.

SUMMARY OF THE INVENTION

The present invention overcomes the foregoing deficiencies in Bourke engines heretofore manufactured and tested by so constructing the underside of the head of each piston to provide a cylindrical recess defined in part by a cylindrical wall coaxial with the piston head and extending outwardly from the inside thereof for a predetermined distance. The inside diameter of the cylindrical wall defining the cylindrical recess is slightly greater than the outside diameter of the piston rod so that the latter may be inserted into such recess to where the end thereof abuts directly against the inside of the piston head. The rod is secured in the cylindrical recess by a wrist pin passed through the cylindrical wall and the piston rod, both of which are orificed in register to permit the wrist pin so to be passed therethrough. Desirably the orifices through the cylindrical wall are configured slightly elliptically to allow for some lateral play of the wrist pin when the piston is reciprocated during operation of the engine. Thereby the piston may properly center itself in the cylinder axis to avoid undesired friction between the piston and the wall of the cylinder in which it reciprocates, in some limited area of contact between them.

It is a further feature of the present invention to provide a modified yoke assembly whereby the outwardly protruding ends of the piston rods may be secured in coaxial alignment with each other and with the respective cylinders on either side of the yoke to reciprocate as a unit. Instead of providing within the yoke a roller bearing in a slot-like bearing surface for transverse movement relative to the axis of reciprocation of each pair of cylinders, as in the Bourke engines heretofore constructed and tested, the present invention contemplates providing the yoke in the form of a rectangular housing adapted to reciprocate in the direction of movement of the pistons and their piston rods within an oversized crankcase housing. In addition, within this rectangular yoke housing are provided transverse lubricated tracks or races in and between which there is further reciprocable a slider block. The latter is orificed coaxially with and to permit the passage therethrough of a crank throw of a crankshaft or crank balancing wheel. Provision is further made for the grooving of one or both of the contacting surfaces of the slider block and the races within which such slider block is reciprocable. Such grooves may be further orificed to permit oil to be fed into such grooves to improve lubrication of the surfaces. The grooves, moreover, in addition to enabling the contacting surfaces to be well lubricated, will reduce the total area of the contacting surfaces of the slider block and the races in and between which the slider block reciprocates.

With these improvements in the Bourke engine, it will be found that the piston thrust may be imparted directly to the piston rod and without side loading effects, the sole function of the wrist pins being to retain the ends of the piston rods in the cylindrical recesses and in abutment with the inner sides of the piston head wall, but with a small amount of play to enable the piston to properly center itself in the cylinder within which it reciprocates. With the slider block type yoke assembly, the frictional resistance and wear which has heretofore been a problem with Bourke type engines is effectively obviated so that engines incorporating the present invention may be operated for long periods of time without breakdown.

DESCRIPTION OF THE PREFERRED EMBODIMENT

Figure 1:
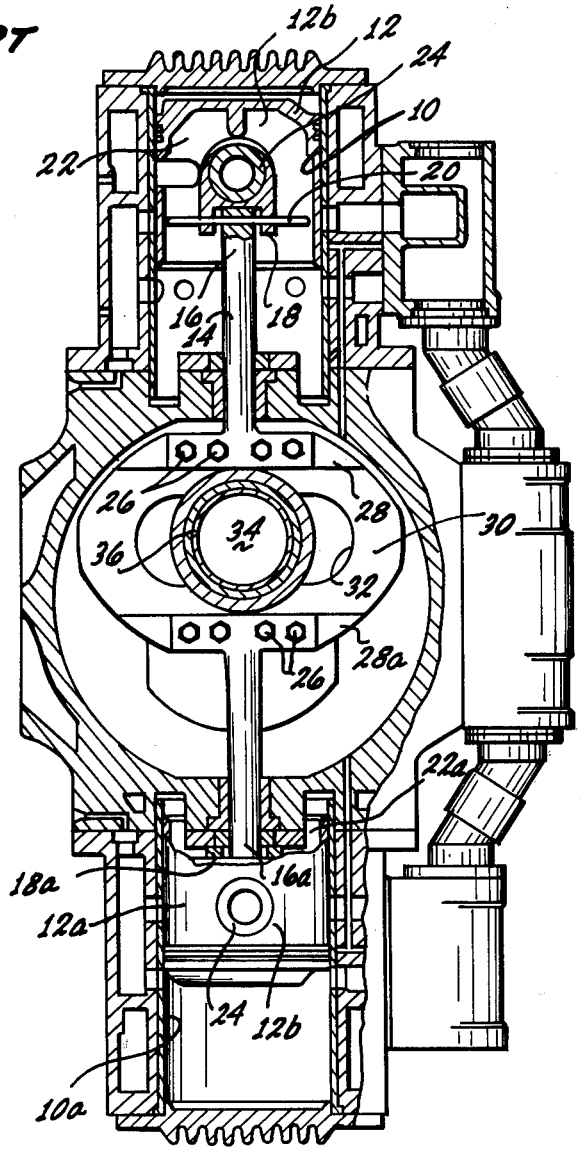
FIG. 1 PRIOR ART
FIG. 1 is an end elevation partly in section of two cylinders of a Bourke engine constructed in accordance with the prior art.

FIG. 1 is illustrative of the basic construction of a Bourke engine, as such engine is illustrated on page 37 of the publication entitled *Bourke Engine Documentary*, hereinabove more fully described. Essentially, two cylinders 10,10*a* are coaxially disposed symmetrically and oppositely back to back. A cylindrical piston 12 or 12*a* is provided to reciprocate in each cylinder 10 or 10*a*, respectively, with a piston rod 14,14*a* having its inner end 16,16*a* connected to the piston 12,12*a* by means of a yoke 18,18*a* to which the rod ends 16,16*a* are attached respectively, each by a wrist pin 20. Each yoke 18,18*a* is held in position within the chamber 22,22*a* defined by the cylindrical head 12,12*a*, by the further pin 24 which extends through and between the side walls 12*b* of the piston 12 or 12*a*. The two piston rods 14,14*a*, which extend from the two opposed pistons 12,12*a*, respectively, are secured by bolts 26 to opposite ends 28,28*a* of a yoke housing 30, in coaxial alignment with each other and with the pistons 12,12*a*. As may be further seen from FIG. 1, the yoke housing 30 is centrally slotted at 32 to receive the throw 34 of a crank (not shown). It is intended that the throw 34, which is encircled by one or more roller bearing sleeves 36, will move from left to right, and back from right to left in the slot 32 while the piston rods 14,14*a*, joined by the yoke housing 30, are moving simultaneously in an up or down direction. Thereby, the reciprocating motion of this rod-yoke assembly housing unit may be converted to a rotary driving motion imparted to the crank throw 34.

Figure 2:
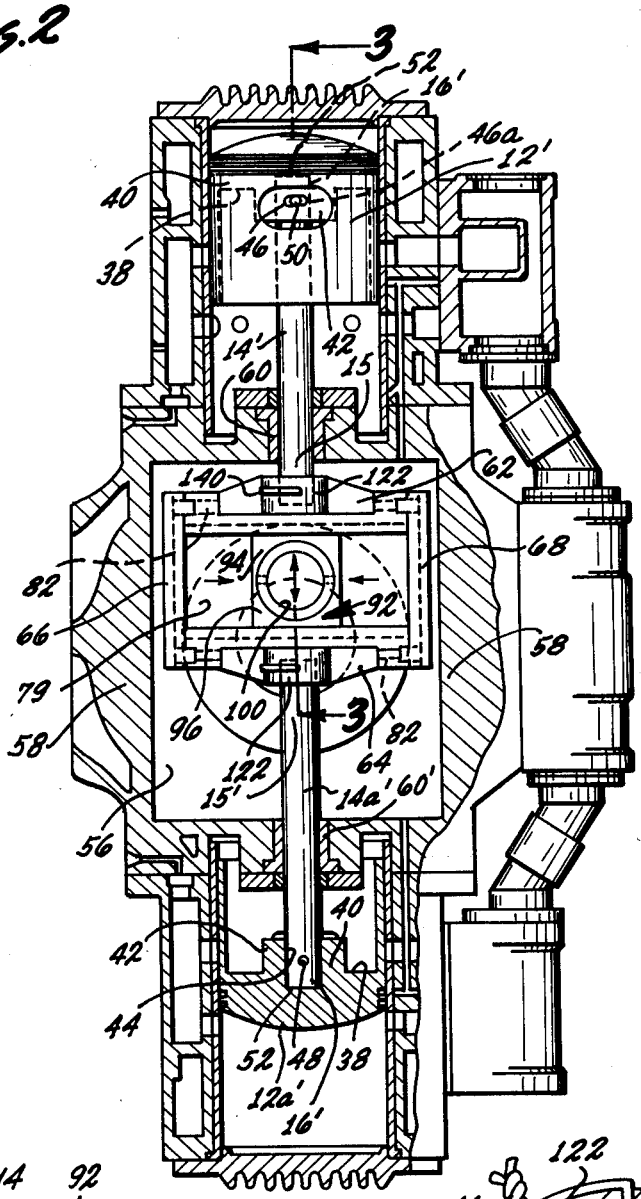
FIG. 2 is a view similar to that of FIG. 1, but showing the present invention incorporated in and replacing certain portions of the engine shown in FIG. 1.
Figure 6:
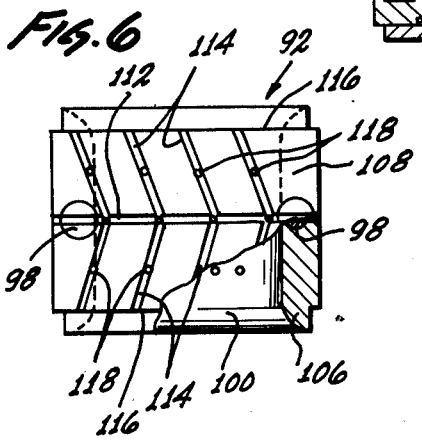
FIG. 6 is an enlarged view partly broken away of the slider block shown in FIG. 4.

The improvements in this conventional form of Bourke engine shown in FIG. 1 and thus briefly described, are illustrated in FIGS. 2 through 7. Considering, first, the manner in which the piston rods 14', 14*a'* are secured to the pistons 12', 12*a'*, respectively, as shown in FIG. 2, the connection of the rod 14' to the piston 12' will be discussed only, it being understood that the attachment of the rod 14*a'* to the piston 12*a'* is accomplished in an identical manner. Thus, the underside 38 of the piston head 40 of the piston 12' is configured to provide a downwardly extending cylindrical wall 42, having an inside diameter slightly larger than the outside diameter of the end 16' of the piston rod 14' so that such end 16' may be inserted within the cylindrical well 44 defined by the wall 43. A pair of diametrically opposed orifices 46,46*a* are provided in the wall 43, said orifices being somewhat laterally extended on both sides so that the orifices are almost elliptical. A transverse orifice 48 is provided in the end 16' of the rod 14', the axis of said orifice 48 coinciding with the axis of the orifices 46,46*a* through the cylindrical wall 43. The orifice 48 is further so disposed in relation to the end 16' of the rod 14' that when the end 16' of the rod 14' is inserted in the cylindrical well 44 to where the end 16' of the rod 14' abuts the inner transverse wall 52 of the well 44, defined by the cylindrical wall 43, and the end 16' properly turned in the well 44, the orifice 48 will be disposed in register with the orifices 46,46*a* in the wall 42. A wrist pin 50 may then be passed through said registering orifices 46,46*a* and 48, thereby to secure the end 16' of the piston rod 14' in the well 44. With such abutment of the end 16' of the rod 14' against the inner transverse wall 52 of the well 44, all thrust either way in the axis of the rod 14' and the piston 12', either by the piston head 40 downwardly against the end 16' of the rod 14', or conversely by such end 16' upwardly against the bottom wall 38 (including the well bottom wall 52) of the piston head 40 is transferred directly by such abutting surfaces, and none of such thrust load is required to be carried by the pin wrist 50 or other pin, as in the FIG. 1 illustration of the Bourke engine.

The yoke assembly of the present invention comprises the rectangular housing 54 which is of an overall size such that it may be reciprocated within the crankcase space 56 without touching the walls 58, which define such space. This housing 54 serves to receive the ends 15,15' of the two piston rods 14,14', respectively. Both of these rods 14,14' are coaxially aligned for reciprocation by the respective bearing sleeves 60,60'. The construction of the housing 54 and the manner in which the ends 15,15' of the rods 14,14', respectively, are secured to this housing is shown fully in FIGS. 4 through 7, inclusive.

Although a reciprocating housing which performs the functions of that illustrated in the drawings and described herein may be constructed in many different ways and with different configurations, the housing and slider block assembly, which is herein illustrated and is about to be described, is believed to be most effective in accomplishing the results which are desired to be obtained in this modified version of the Bourke engine. Essentially, the housing 54 is constructed of a pair of identical top and bottom members 62,64 which interfit with a pair of identical side members 66,68. Such interfitting may be accomplished by providing rectangular grooves 70 to extend across the outside of each rectangular block-like end 61 of the members 62,64, and mating projecting rectangular runners 72 which extend across the inner side 74 of each member 66,68 adjacent each end thereof. A threaded orifice 76 is tapped perpendicularly through the bottom wall 78 defining the groove 70, and a registering orifice 80 is drilled through each member 66,68 near its outer end to pass through each runner 72. Thus, when the runners 72 of the member 66 or 68 are brought into fitting engagement with the grooves 70 in the upper and lower members 72, the members 66 and 68 may be secured to members 62 and 64 by inserting screws 82 through the orifices 80 and threading them into the tapped screw holes 76 in the bottom walls 78 of the members 62 and 64. Thereby, all four members 62,64,66 and 68 may be interfitted and secured together against movement relative to each other to define centrally a rectangular opening 79. The inner opposing faces 84 of the top and bottom members 62,64 are machined or otherwise formed to provide channels 86 which extend for the full length of each of the members 62,64. Desirably, the bottom walls 88 of these channels have cut or otherwise formed in them a pair of parallel grooves 90 to permit oil flow in a manner hereinafter to be explained. These channels 86, as thus grooved, serve as races along which a slider block 92 may be reciprocated.

Figure 4:
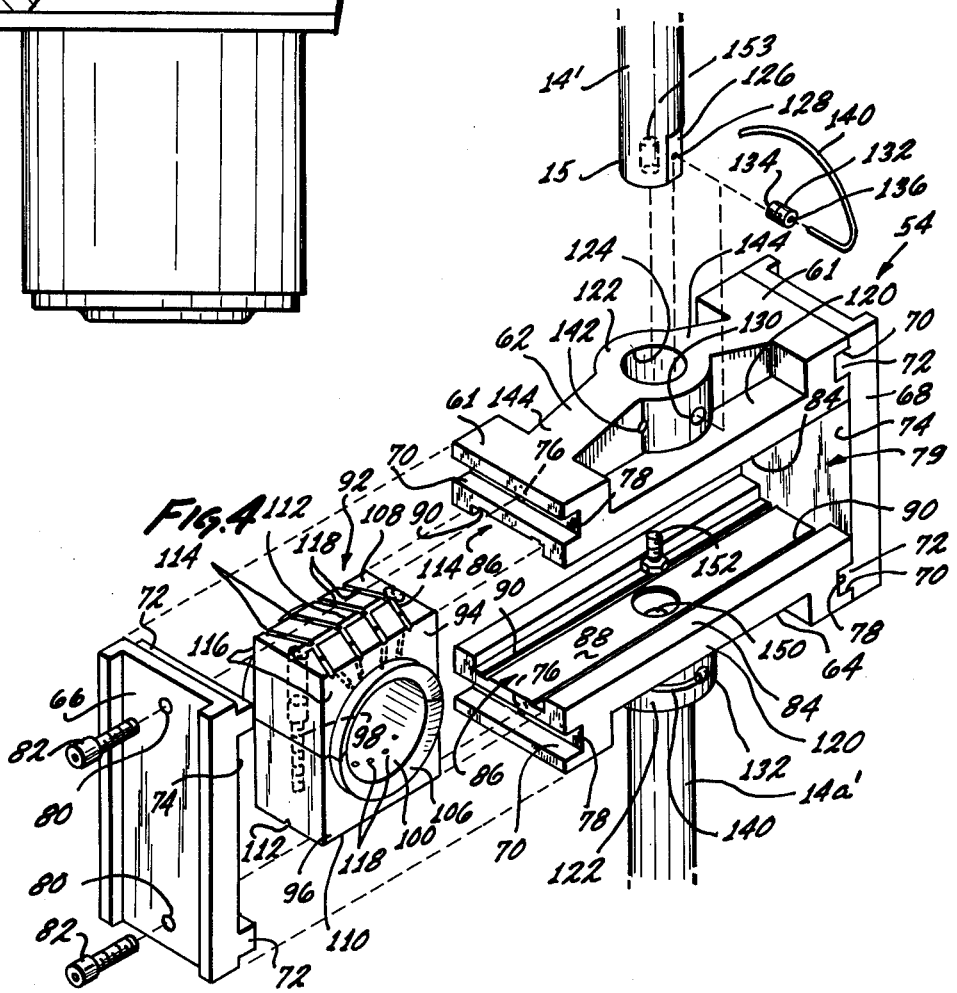
FIG. 4 is a perspective exploded view of the yoke and slider block assembly.

The slider block 92 may be formed as an integral unit or, as shown in FIG. 4, it may be constructed of two identical halves 94,96 held together by counter-sunk screws 98. The mating sides of the two halves 94,96 of the slider block 92 are machined or otherwise formed so that when they are brought together they define a large cylindrical orifice 100 to fit closely about the throw 34' of a crank or balance wheel 102, constituting a part of a crankshaft 104. In order to provide a smooth and close fit about the throw 34', a beveled collar 106 may also be provided to extend from each side of the slider block 92. Obviously, the two halves 94,96, including the halves of the beveled collar 106 should be fabricated of a material which will provide excellent bearing surfaces about the crank throw 34'. For the purpose of providing optimum lubrication of the slider block 92 in its reciprocal movements in the channels 86, the top and bottom sides 108,110 may each be provided with a central groove 112 which extends the full length of such top or bottom side of the block 92. Additionally, a plurality of branch grooves 114 may be provided to extend from the central groove 112 transversely toward the opposite side edges 116 of the top and bottom sides 108,110 of the block 92. Further, orifices 118 desirably are drilled down from each branch 114 through the block half 94,96 to the central orifice 100.

Desirably, neither top nor bottom member 62,64 should be a plain, rectangular plate which if thick enough to provide the interfitting at its ends as hereinabove described, would be quite heavy in weight to adversely affect the operation of the engine. The top and bottom members 62,64 should be lightened to the greatest extent possible consistent with ability at all times to maintain its rigid configuration and to perform its various functions. Such lightening of the weight of each member 62,64 may be accomplished by providing a relatively thin control wall section 120 with block-like ends 61 for interfitting with the side member 66,68 as hereinabove described. However, since in addition to providing such interfits with the side members 66,68, the top and bottom members 62,64 each serve to receive and retain respectively the ends 15,15' of the piston rods 14,14', respectively. Each member 62,64 may also be formed with an outwardly cylindrical wall 122 defining a well 124. This well should have an inside diameter sufficiently larger than the outside diameter of the piston rod ends 15,15' to permit one of the latter to be received in a well 124. One side of each of the ends 15,15' of the piston rods 14,14' is flattened as at 126 and an orifice 128 is drilled perpendicularly to such flattened area diametrically through the end 15 or 15'. In addition, a threaded orifice 130 is provided through the cylindrical wall 122 which defines the well 124. Each end 15,15' of a piston rod 14,14', respectively, may thus be secured in the well 124 and against turning by bringing the end down into the well to where the orifices 130 and 128 fall into register so that a screw 132 may be threaded into the orifice 130 so that the inner end 134 of the screw 132 comes into tight abutment with the flattened surface 126 of the end 15,15' of a piston rod 14,14', respectively. The screw 132 desirably should be axially orificed at 136 and the diametrically opposite portion 122a of the cylindrical wall 122 may be provided with a small further orifice 138 coaxial with the orifices 128 and 136, so that a wire 140 may be passed through said registering orifices and through a further orifice 142 in one of the support walls 144 to be twisted as at 146, thereby securing the screw 132 against loosening and withdrawal from the orifice 130 and otherwise preventing the end 15,15' from rotating in the well 124.

Since the full thrust of each cylinder is applied to the thinner wall section 120 of each member 62,64 via the cylindrical wall 122, it is desirable to reenforce such wall section against possible distortion from such thrust loads which distortion might impede the free lateral reciprocation of the slider block 94 in the race channels 88. Such desired reenforcement may be accomplished while minimizing the added weight to each member 62,64, by providing the support walls 144 to extend between the cylindrical walls 122 and the block-like ends 61 of the members 62,64. Thereby, sufficient support is provided to prevent any bending of the members 62,64 under the heavy thrust loads which are imparted to the housing 54 when the driving thrust is applied by the piston rods 14,14' to that housing. At the same time, the configuration of the top and bottom members 62,64 illustrated and herein described, provides much lighter top and bottom members than would otherwise be possible if solid block configurations were adopted. As heretofore mentioned, any lightening of the total weight of the reciprocating piston, piston rod and yoke combination contributes materially to a more efficiently operating engine.

Figure 7:
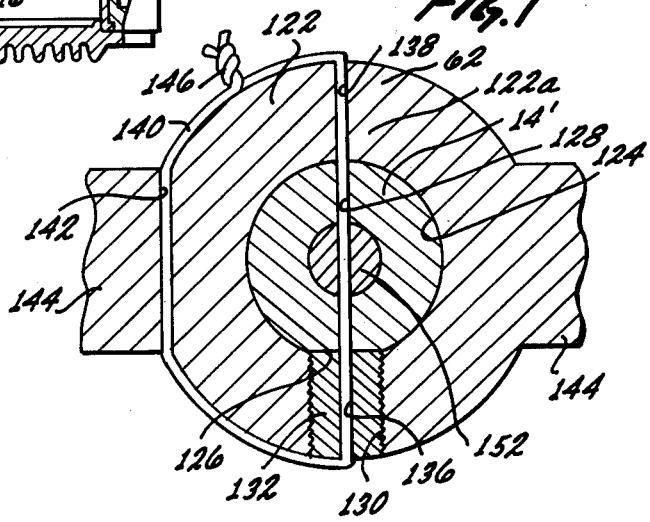
FIG. 7 is an enlarged section taken on the line 7—7 of FIG. 3.
Figure 3:
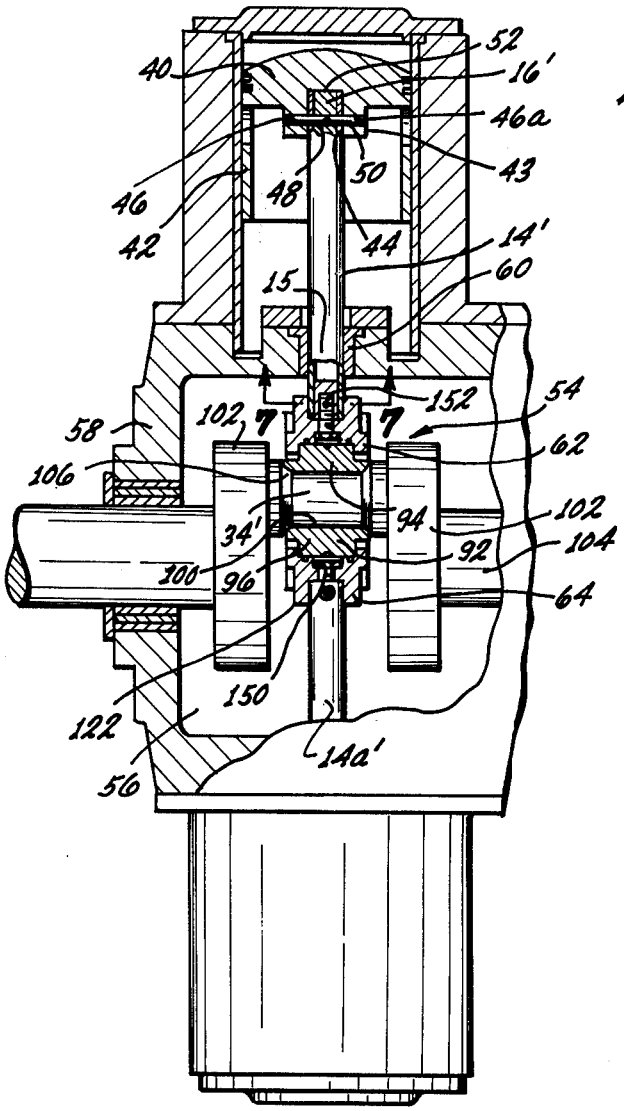
FIG. 3 is a side elevation of the two cylinders shown in FIG. 2 showing a section taken on the line and looking in the direction of the arrows 3—3 in FIG. 2.
Figure 5:
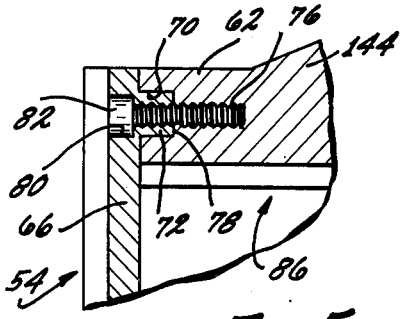
FIG. 5 is an enlarged view of the circled corner of the yoke in FIG. 2.

It should also be pointed out that the well 124 does not extend all the way through to the bottom wall 88 of the channel 86 in either of the top or bottom members 62,64. However, a small coaxial screw hole 150, which is counter-sunk below the surface of the bottom wall 88, may be provided so that a screw 152 may be inserted coaxially with the well and threaded into a threaded hole 153 extending inwardly from each end 15,15′ of the piston rod 14,14′, thereby further to better secure the piston rod in the well 124. To better secure the screw 152 against being vibrated out of the hole 153, it should also be orificed at 155 so that when the screw 152 is threaded tightly in the hole 153, the orifice 155 will be in register with the orifices 128,136 and 138 to permit the wire 140 also be to passed through the screw 152 as shown in FIG. 7.

In use, then, after the two halves 94,96 of the slider block 92 are brought and held together over the crank throw 34′ by screws 98, the housing 54 is assembled about the slider block 92 so that it is fitted into the channels 86 for sliding lateral reciprocation therein. The ends 15,15′ of the piston rods are slipped into the wells 124 and secured in the manner hereinabove explained. When the crankcase is then closed and provided with lubricant, the engine is now ready to be operated.

It will be appreciated that all of the thrust of each of the pistons 12,12′ is imparted directly upon the ends 16′, 16*a*′ of the piston rods 14′,14*a*′ which are in abutment with the undersides 38 of the pistons 12,12′ and such thrust from one piston is conducted axially in the direction of the opposite piston through the yoke housing 54.

It will also be appreciated that with the slider block assembly being well lubricated, it will reciprocate between the insides 74 of the side members 66,68 within the channels 86 in the top and bottom members 62,64. The top and bottom grooved bearing surfaces of the slider block 94 distribute the piston thrust evenly over the channel walls 88 and are well lubricated by oil passing in and out of the grooves 112,114 and along the channel walls 88. Since the block 94 is symmetrical in its design, at any time when the engine is being serviced, the block 94 may be taken out and reversed. Similarly, the top and bottom members 62,64 may be turned over and substituted for each other. By such reversals and substitutions, the half of each channel surface which does not receive the thrust load during reciprocation of the slider block 94 and rotation of the crank throw 34 in one disposition, may be put into thrust load bearing service. In this manner, all of the bearing surfaces of the yoke housing assembly may, in effect, have their wear lives doubled.

It will be appreciated by those skilled in the art that the present invention renders much more practical the operation of a Bourke type engine.

I claim:

1. In an internal combustion engine having at least two cylinders disposed coaxially and oppositely so that the free ends of piston rods extending from pistons reciprocable in said cylinders, may be connected by a yoke in coaxial alignment with each other and with the cylinders to reciprocate concurrently as a unit, said yoke having means rotatably to engage a rotating crank by which the force developed by reciprocation of the pistons is converted to rotating driving motion, the improvement which comprises:

a cylindrical recess in the underside of each piston head, said recess being defined in part by a cylindrical wall coaxial with the piston head and extending outwardly therefrom for a predetermined distance, the inside diameter of said cylindrical wall being slightly greater than the outside diameter of the piston rod insertable in said recess, one end of said piston rod being insertable in said recess to abut the piston head, and means to retain said piston rod end in said cylindrical recess while still allowing for sufficient deviation from the common axis to prevent wear in a particular area between each piston and the surrounding wall of the cylinder in which it reciprocates upon such reciprocation during operation of the engine.

2. In an internal combustion engine having at least two cylinders disposed coaxially and oppositely so that the free ends of piston rods extending from pistons reciprocable in said cylinders, may be connected by a yoke in coaxial alignment with each other and with the cylinders, to reciprocate concurrently as a unit, said yoke having means rotatably to engage a rotating crank by which the force developed by reciprocation of the pistons is converted to rotating driving motion, the improvement which comprises:

a cylindrical recess in the underside of each piston head, said recess being defined in part by a cylindrical wall coaxial with the piston head and extending outwardly therefrom for a predetermined distance, the inside diameter of said cylindrical wall being slightly greater than the outside diameter of the piston rod insertable in said recess, one end of said piston rod being insertable in said recess to abut the piston head, said rod end being diametrically orificed to receive therethrough a wrist pin, and said cylindrical wall being orificed diametrically in register with the orifice in the rod end to permit the wrist pin also to be passed through said cylindrical wall, the orifices in said cylindrical wall being configured slightly elliptically to allow for some lateral play of the wrist pin in the last said orifices when the piston is reciprocated during operation of the engine.

3. In an internal combustion engine having at least two cylinders disposed coaxially and oppositely so that the free ends of piston rods extending from pistons reciprocable in said cylinders may be connected by a yoke assembly in coaxial alignment with each other and with the cylinders to reciprocate concurrently as a unit in a first direction, said yoke assembly having means rotatably to engage and reciprocate in a second direction perpendicular to said first direction a rotating crank by which the force developed by reciprocation of the pistons is converted to rotating driving motion, the improvement in the yoke assembly which comprises:

a housing, said housing defining a rectangular passage extending in said second direction, and being disposed equidistant from both pistons, said housing having means in opposite walls to receive and fixedly hold the free end of the piston rod extending from each piston and in said coaxial alignment, said passage being defined at least in part by a pair of opposing races, said races lying in planes parallel to each other and perpendicular to the common cylinder and piston rod axis;

a block slider reciprocable in and between, and having opposite faces in contact with, said opposing races in said second direction, said block slider being cylindrically orificed transversely of both said first and second directions, to engage rotatably the said crank rotatable about an axis of rotation parallel to the axis of said cylindrical slider orifice;

each of said races being grooved to reduce the bearing surface contacted by said slider block and to provide oil flow passages in the surfaces of said races.

4. In an internal combustion engine having at least two cylinders disposed coaxially and oppositely so that the free ends of piston rods extending from pistons reciprocable in said cylinders may be connected by a yoke assembly in coaxial alignment with each other and with the cylinders to reciprocate concurrently as a unit in a first direction, said yoke assembly having means rotatably to engage and reciprocate in a second direction perpendicular to said first direction a rotating crank by which the force developed by reciprocation of the pistons is converted to rotating driving motion, the improvement in the yoke assembly which comprises:

a housing, said housing defining a rectangular passage extending in said second direction, and being disposed equidistant from both pistons, said housing having means in opposite walls to receive and fixedly hold the free end of the piston rod extending from each piston and in said coaxial alignment, said passage being defined at least in part by a pair of opposing races, said races lying in planes parallel to each other and perpendicular to the common cylinder and piston rod axis;

a block slider reciprocable in and between, and having opposite faces in contact with, said opposing races in said second direction, said block slider being cylindrically orificed transversely of both said first and second directions, to engage rotatably the said crank rotatable about an axis of rotation parallel to the axis of said cylindrical slider orifice; each face of said slider block in contact with one of said races being grooved to reduce the actual surface thereof in contact with said one of said races and to provide oil flow passages between said bearing surface and said races during reciprocation of said slider block in said passage.

5. The improved yoke assembly as described in claim 4 wherein oil passage orifices are provided to extend between at least some of the grooves in said slider block and the said cylindrical therein.

6. The improved yoke assembly as described in claim 3 wherein the housing is comprised of one pair similar top and bottom plate members and another pair of similar side plate members, each said pair of plate members having means to interfit then in the vicinity of their respective ends with the ends of the other pair of plate members so that, when so interfitted, they define said rectangular passage, and the top and bottom members further each having a projecting cylindrical wall extending in the common axis to define a cylindrical well, said well serving to receive the free end of one of said piston rods, and means to secure the last said piston rod ends in said wells.

7. The improved yoke assembly as described in claim 5, wherein the ends of the top and bottom members are in the form of rectangular blocks and support walls are provided to extend between each of said cylindrical walls and the said rectangular block ends of said top and bottom members.

* * * * *